United States Patent [19]

Lin et al.

[11] Patent Number: 4,804,193

[45] Date of Patent: Feb. 14, 1989

[54] CIRCUITRY FOR ELECTRONIC SCORING DARTBOARD

[75] Inventors: Jui S. Lin; Daniel Lin, both of Taipei, Taiwan

[73] Assignees: An Wei Enterprise Co., Ltd; Cortina International Corp., both of Taipei, Taiwan

[21] Appl. No.: 98,975

[22] Filed: Sep. 21, 1987

[51] Int. Cl.[4] ..... F41J 5/04

[52] U.S. Cl. ..... 273/376

[58] Field of Search ..... 273/376, 374

[56] References Cited

U.S. PATENT DOCUMENTS 3,972,531 8/1976 Knapp ..... 273/376

4,057,251 11/1977 Jones et al. ..... 273/376

4,635,940 1/1987 Kelley ..... 273/376

*Primary Examiner*—Richard C. Pinkham

*Assistant Examiner*—Benjamin Layno

*Attorney, Agent, or Firm*—Holman & Stern

[57] ABSTRACT

An electronic dartboard which includes a circuit board having a plurality of contacts and a dart-engaging target assembly mounted in front of the circuit board. The target assembly has a plurality of individual scoring blocks. Each block has at least one stem rearwardly protruding towards the circuit board. A conductor point and a buffer ring are provided at the back end of the stem. The buffer ring spaces the conductor point from the contact point. When a dart is thrown on the dartboard the buffer ring deforms engaging the conductor point with the contact point.

1 Claim, 3 Drawing Sheets

CIRCUITRY FOR ELECTRONIC SCORING DARTBOARD

BACKGROUND OF THE INVENTION

The popularity of dart games has been evident, among people from all walks of life, throughout history. For example, dartboards have become a mainstay of pubs and home living rooms, but the tedious task of scoring darts manually has noticeably lessened the interest in this game. On this basis, inventors have tried to design electronic scoring dartboards that would automatically score, add up and display points for the players to increase interest and the entertainment aspect of the game.

The subsequent inventions proved to be unfeasible for mass production because of its use of a spring-blade for conductivity. The use of this type of conductor also caused inaccuracy of point scoring due to the poor conductivity of the spring-blades.

To eliminate these flaws in the design of the circuitry, this inventor continued research and the redesigning of the device, and only after years of work and research, he manage to complete a redesigned electronic scoring device.

This invention is the new conductor circuitry for an Electronic Scoring Dartboard. On the interior of the front board are knobs that are separated from the back circuit board with a buffer-ring.

When the dart is thrown on the board, the knob comes into contact with the circuit board and transmits a signal which is "read" by the device and the points are displayed. This method improves sensitivity and accuracy of scoring.

SUMMARY OF THE INVENTION

This invention concerns a conductor device for an Electronic Scoring Dartboard. On the interior of the front board are knobs that are separated from the back circuit board with a buffer-ring. When the dart is thrown on th board, the knob comes into contact with the circuit board and transmits a signal which is "read" by the device and the points are displayed. This enhances the practicality and the sensitivity of the device.

BRIEF DESCRIPTION OF THE DRAWING (1) Figures Section

FIG. 1—Exploded Illustration of Dartboard
FIG. 2—Cutaway View of Assembled Invention
FIG. 3—B-B Illustration of Invention
FIG. 4—Cutaway View of Device in Use
FIG. 5—A-A Illustration of Invention (2) Numbers Section (1) Target Plate
(2) Scoring Piece
(211) Buffer-Ring
(3) Circuit Board
(11) Scoring Area
(21) Knobs
(212) Conductor Points
(31) Contact Spots

DESCRIPTION OF THE PREFERRED EMBODIMENT

Figure 1:
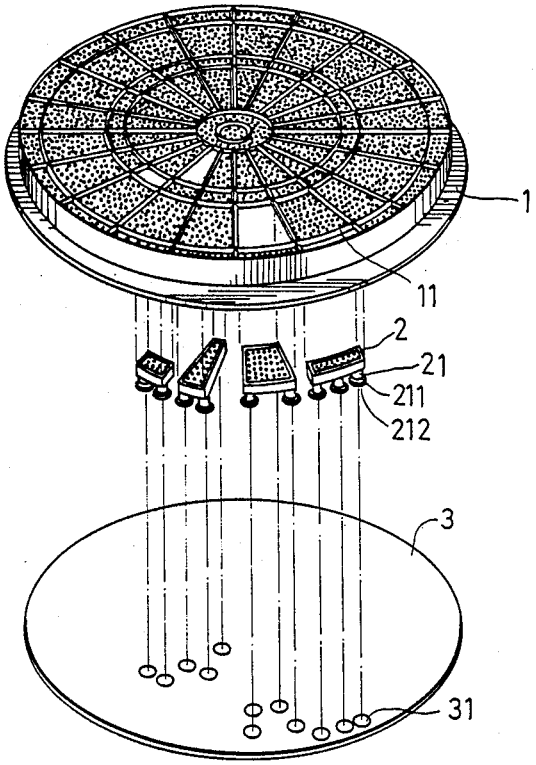

Please refer to FIG. 1. This is the target plate (1) and on the surface is an arrangement of scoring areas (11). On the back of each scoring piece (2) are several knobs (21). On the tip of each knob (21) is a buffer-ring (211) and located inside each buffer ring is a conductor point (212). Moreover, the knob (21) is designed in a location on the back of each scoring piece (2) that is aligned with the contact spots (31) on the circuit board (3).

Figure 2:
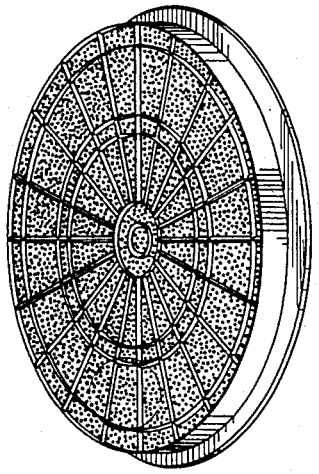

When assembled, please refer to FIG. 2. Insert each scoring piece (2) into its proper position in the scoring area (11) on the target plate (1), then fit the circuit board (3) on and align the contact spots (31) with the scoring piece (2) and the buffer-ring (211).

Figure 3:
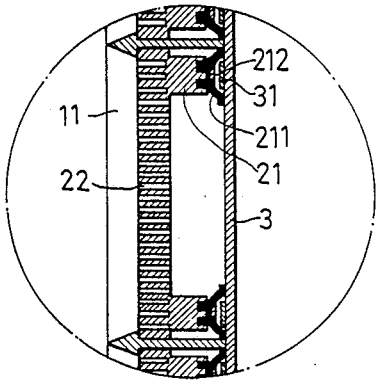
Figure 4:
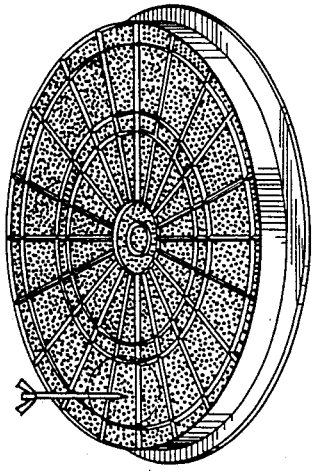
Figure 5:
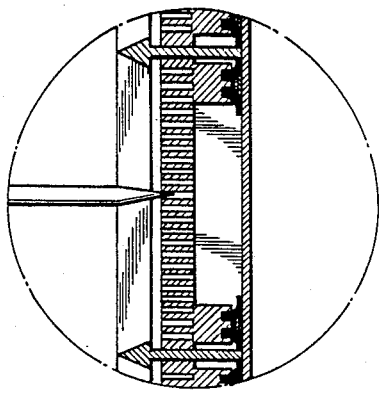

For normal usage, refer to FIG. 3. When the dart strikes the scoring piece (2) in the scoring area (11) on the target plate (1), the scoring piece (2) will, because of the striking force, move towards the circuit board (3). At this time, the buffer-rings (211) on the knobs (21) are contorted, permitting the conductor points (212) to come into contact with the contact spots (31) on the circuit board (3). A signal is then transmitted through the circuits and the buffer-rings will then slowly recede, causing the scoring piece (2) to return to its normal position.

We claim:

1. An electronic dartboard structure which includes a circuit board having a surface provided with a plurality of contact points, a dart-engaging target assembly mounted on the circuit board, said assembly including a plurality of scoring blocks, each block having at least one rearwardly protruding stem with a back end provided with a conductor point and a buffer ring on the back end of the stem, the buffer ring having an inner end secured to the stem surrounding the conductor point, the buffer ring further having an outer end resting on the circuit board surrounding one of said contact points, the buffer ring spacing the conductor point from the contact point and being deformable to allow engagement of the conductor point with the contact point when the scoring block is impacted by a dart.

* * * * *